United States Patent [19]

Bourlet

[11] 4,142,443

[45] Mar. 6, 1979

[54] VISUAL CHECKING DEVICE FOR MACHINE GUNS AND SIMILAR WEAPONS

[75] Inventor: Maurice V. Bourlet, Liège, Belgium

[73] Assignee: Fabriqe Nationale Herstal S.A., Herstal, Belgium

[21] Appl. No.: 788,341

[22] Filed: Apr. 18, 1977

[30] Foreign Application Priority Data

Jun. 23, 1976 [BE] Belgium ..... 255132

[51] Int. Cl.[2] ..... F41D 9/02

[52] U.S. Cl. ..... 89/33 R; 89/33 C

[58] Field of Search ..... 89/33 R, 33 B, 33 BB, 89/33 BC, 33 C, 33 LA; 42/1 B, 1 D

[56] References Cited

U.S. PATENT DOCUMENTS 2,116,860 5/1938 Blaylock et al. ..... 42/1 B 3,762,268 10/1973 Gaye ..... 42/1 B

FOREIGN PATENT DOCUMENTS 1290 of 1886 United Kingdom ..... 42/1 D

*Primary Examiner*—Stephen C. Bentley

*Attorney, Agent, or Firm*—Bacon & Thomas

[57] ABSTRACT

The invention pertains to a visual checking device for machine guns and similar weapons, characterized by the fact that it is made up of a lever or toggle lever, permanently stressed by a return spring in the direction of the location of the successive rounds of the supply belt, in such a manner that aforesaid lever or toggle lever can take up two positions, respectively an upper position when it makes contact with a cartridge, and a lower position when no cartridge is present.

1 Claim, 3 Drawing Figures

VISUAL CHECKING DEVICE FOR MACHINE GUNS AND SIMILAR WEAPONS

Figures 1, 2, 3:
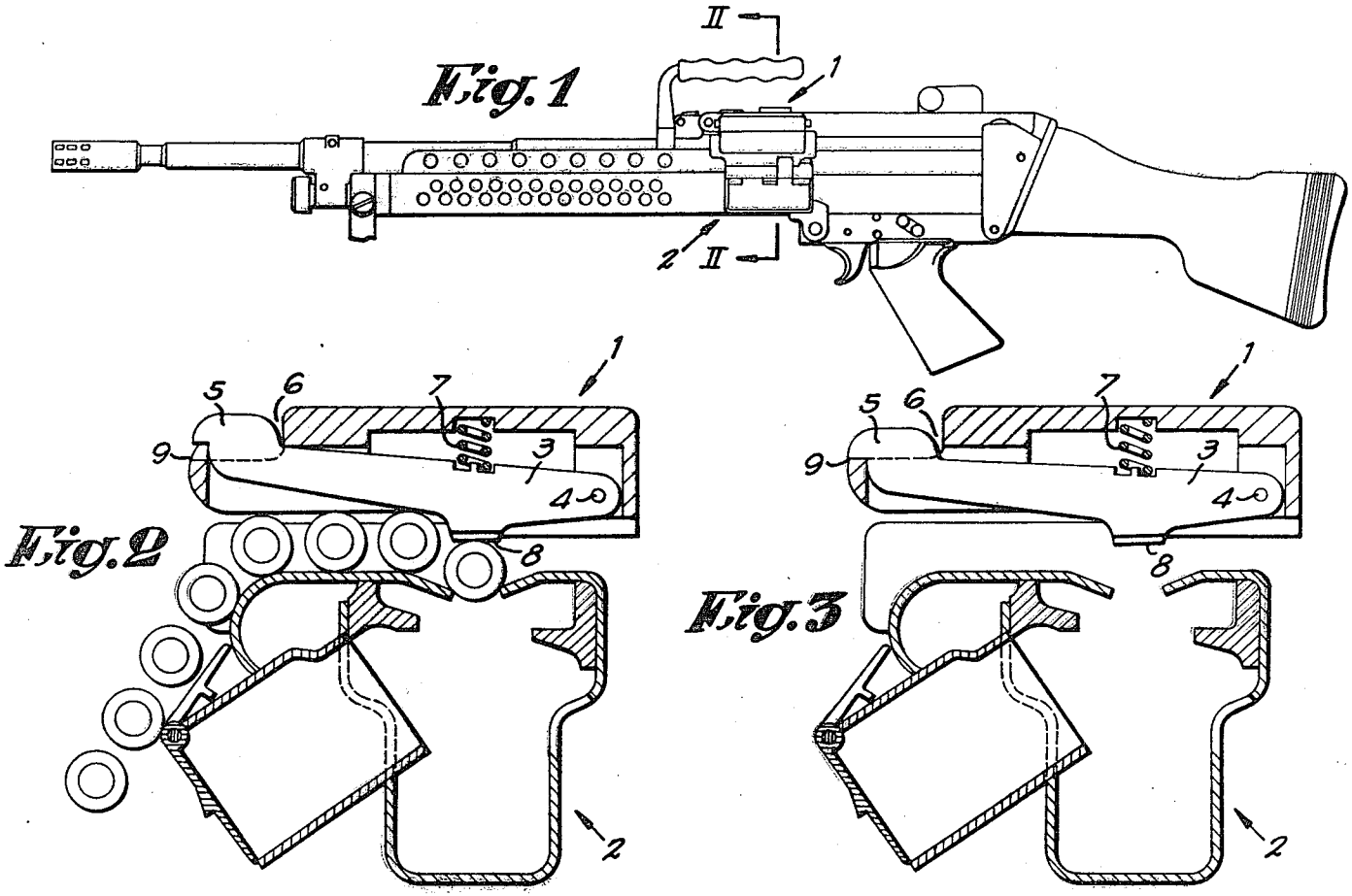

It is a well known fact, that in a conventional machine gun supplied by belts, there is no way of knowing whether or not there is a round in the feed channel, except by lifting the cover which shuts off the supply system.

Such an arrangement is inconvenient and the operation is likely to cause the operator to be located, which it is of course important to avoid.

The present invention pertains to an extremely simple visual checking device, permanently showing the belt supply condition.

The checking device according to the invention is mainly characterized by the fact that it is made up of a lever or toggle lever which is permanently stressed by a return spring in the direction of the location of the successive cartridges of the supply belt, in such a manner that said lever or toggle lever can take up two positions, respectively an upper position when it is in contact with a cartridge and a lower position in the absence of any cartridge.

One of the ends of aforesaid lever or toggle lever forms the actual visual checking element, considering that its respective upper and lower positions are instantaneously visible by the operator, without the slightest handling or movement of the weapon.

This visual checking device may be fitted in the cover of the weapon case in such a manner, that the operator may at any moment and without previous handling, be informed whether or not there is a round which is ready to be fired.

It is obvious that the various constituent elements of this permanent checking device are essentially variable in their shape, their dimensions and their relative locations, providing that the construction be such, that the visual checking element itself is directly visible by the operator without altering the position of the weapon.

A form of embodiment is described hereinafter in greater detail with reference to the appended drawings in which:

FIG. 1 schematically shows a lateral view of a weapon, to which the visual checking device according to the invention has been fitted;

FIG. 2 shows to a larger scale, a section according to line II—II in FIG. 1, whereby the checking element indicates the presence of a round ready to be fired; and FIG. 3 is similar to FIG. 2, whereby however the checking device indicates the absence of any cartridge ready to be fired.

This form of embodiment illustrates a traditional firearm in which the visual checking device, subject of the invention, has been incorporated. In cover 1 of casing 2, a lever or toggle lever 3 is hingedly fitted, at one end, upon an axle 4, and conditioned, at its other end, to form a pointer 5 which protrudes with respect to the corresponding part of cover 1. This pointer 5 may move in a slot 6, machined for this purpose in aforesaid cover 1. Along the extension of the center line of an elastic element, such as for instance a spring 7, the lever or toggle lever 3 has a small pad 8 which will rest successively on each of the cartridges as they are forwarded by the uncoiling of the belt.

When the supply is normally in progress, the lever or toggle lever 3 is stressed in opposition to the reaction of aforesaid spring 7, and pointer 5 is in its upper position, which is clearly visible by the operator without any handling or change of position.

In the absence of a cartridge for the feed of the weapon, aforesaid pad 8, and respectively the lever or toggle lever 3, no longer have a support and are pushed back so as to rotate around axle 4, and consequently bring point 5 to its lower or retracted position, by making contact with the stop 9 provided on cover 1. By means of such a visual checking device, the operator is provided with a particularly important safety feature, when taking into consideration the circumstances under which such firearms are being used. This safety is all the more efficient, because the operator, whilst keeping the arm to his shoulder, is being informed whether he has any rounds left to fire or not.

The invention pertains to the checking device in itself, as well as to any and all weapons which would be fitted with such a visual checking device.

What I claim is:

1. A visual checking device for a machine gun having a feed channel for directing successive cartridges to a firing chamber, said checking device comprising:

a lever pivotally mounted over said feed channel;

biasing means urging said lever to swing toward said channel to project at least a lower portion of said lever into said channel adjacent said chamber to a first position when a cartridge in said channel is engaged thereby or a second position when there is no cartridge therein;

a second portion of said lever being visible from the exterior of said gun to indicate whether said lever is in said first or second position;

a cover over said channel, said lever being below said cover and said biasing means being a spring between and reacting against said cover and lever;

said lower portion of said lever comprising a downwardly projecting pad on said lever directly opposite the region of contact between said spring and lever; and said second portion of said lever being a visible pointer movable in a slot in said cover.

* * * * *